United States Patent [19]

Dye, Jr.

[11] 4,159,692

[45] Jul. 3, 1979

[54] METHOD OF SUBMERGING FLOATATION BODIES AND APPARATUS FOR PERFORMING SAME

[76] Inventor: Wayne K. Dye, Jr., 1701 Clackamette Dr., Oregon City, Oreg. 97045

[21] Appl. No.: 844,787

[22] Filed: Oct. 25, 1977

[51] Int. Cl.[2] ..... B63G 8/00

[52] U.S. Cl. ..... 114/333; 114/315; 114/53

[58] Field of Search ..... 61/69 R, 97; 114/121, 114/123, 125, 312, 315, 317, 321, 330, 331, 333, 267, 44, 49, 50, 51, 52, 53

[56] References Cited

U.S. PATENT DOCUMENTS

| | | | |
|---|---|---|---|
| 3,024,753 | 3/1962 | Benson | 114/263 |
| 3,198,157 | 8/1965 | Livias | 114/49 |
| 3,434,443 | 3/1969 | Estabrook | 114/315 |
| 3,442,240 | 5/1969 | Wild | 114/315 |
| 3,593,533 | 7/1971 | Washington | 61/69 R |
| 3,845,634 | 11/1974 | Rosenberg | 61/97 |
| 3,978,807 | 9/1976 | Nitzki | 114/123 |

FOREIGN PATENT DOCUMENTS

| | | | |
|---|---|---|---|
| 1902791 | 10/1970 | Fed. Rep. of Germany | 114/266 |

*Primary Examiner*—Trygve M. Blix
*Assistant Examiner*—D. W. Keen
*Attorney, Agent, or Firm*—Chernoff & Vilhauer

[57] ABSTRACT

Apparatus for submerging a floatation body for placement beneath a floating structure is comprised of a tank which is divided into at least two sealed compartments. The tank has a total gross weight which is greater than the buoyancy force of the floatation body and yet has a volume which will allow it to float when filled with air. In order to tailor the gross weight of the tank for use with floatation bodies having a range of buoyancies, weights are removably attachable to the tank. Fluid passageways are provided in the bottom of each compartment, and an air outlet, containing a control valve, is located near the top of each compartment to permit selective flooding of the compartment to submerge the tank. Air inlets entering the top of each compartment are provided with control valves to allow selectively refilling the respective compartments from a remote air generating system. The method includes attaching the floatation body to the tank with straps and opening the air outlet valves until sufficient water enters the tank through the fluid passageways to submerge the floatation body to a depth where it is located beneath the level of the structure. The submerged apparatus is then manipulated until the floatation body is located underneath the structure and pressurized air is forced into the tank from the air generating system through the air inlets, thereby displacing the water out of the compartments through the fluid passageways, until the floatation body is raised to a position where it is completely supported by the structure. The floatation body is then released from the apparatus by removing the straps, and the tank is raised to the surface by completely refilling it with air.

9 Claims, 5 Drawing Figures

METHOD OF SUBMERGING FLOATATION BODIES AND APPARATUS FOR PERFORMING SAME

BACKGROUND OF THE INVENTION

This invention relates to an apparatus for submerging a floatation body beneath a floating structure and the method by which this is accomplished.

When a floating structure, such as a dock, houseboat, etc., ages it often loses buoyancy due to absorption of water which in turn causes the structure to list or even to become partially sunk. When this happens floatation bodies, such as styrofoam logs, are positioned under the structure in order to replace the buoyancy loss of the original structure. However, due to the large buoyancy force generated by these logs, it is difficult to locate them under the structure.

Heretofore this operation has been performed mechanically, requiring large, expensive equipment which must be mounted on floating platforms when used in sites inaccessible by land. Thus placement of the logs, particularly a small number of them at a site which is remote from the normal operation of the equipment, is prohibitively expensive. In addition in many instances it is not possible to even bring the necessary equipment to the site at any cost, therefore making the operation impossible at these sites.

SUMMARY OF THE INVENTION

The present invention comprises a method and apparatus for inexpensively and easily positioning floatation bodies under a structure in order to augment the buoyancy of the structure.

The apparatus includes a cylindrical tank which is divided into two sealed compartments. The tank has weight pockets attached to its sides so that its gross weight can be made greater than the buoyancy force of a wide range of floatation bodies. The pockets are located evenly on both sides of the tank and below its horizontal centerline so that when symmetrically filled with weights the tank is stabilized and prevented from rolling about its longitudinal axis. The tank has a volume which will allow it to float when filled with air even with the weights installed.

Straps for securing logs to the tank are fixedly attached to the tank at one of their ends and are adjustably attached to it at their other ends by means of buckles. Thus the length of the loops formed when the buckles are fastened is adjustable thereby allowing the straps to encircle logs of differing diameters.

Located at the top of each compartment is an air outlet having a valve for regulating the airflow through the outlet or closing it altogether. In the bottom of each compartment is a fluid passageway which is always open. Accordingly by opening the valves in the air outlets the tank is flooded with water through the fluid passageway as air is forced out of the air outlet thus submerging the tank.

Air inlet means, also having a control valve located in it, is located on the top of each compartment and is connected to an air generation source located remotely of the apparatus. Thus once submerged, the tank can be raised again by introducing pressurized air into the tank through the air inlet to displace the water from the tank through the fluid passageways.

The method of using the apparatus comprises fastening a floating floatation body to the tank by means of the straps. The tank then is flooded by opening the air outlet valves and allowing water to enter through the open fluid passageways. Once the tank is submerged to a position where the floatation body is located below the level of the structure, the apparatus is pushed under the structure by a diver. Air from the above water generation source is then pumped into the compartments through the air inlet valves thereby displacing water through the fluid passageways. When sufficient water has been displaced to raise the tank to a level where the floatation body is completely supported beneath the structure, the air inlet valves are closed.

The floatation body is then released by unfastening the straps and the tank is pushed free of the structure leaving the floatation body in place to help support the structure. The tank is then completely filled with air to bring it up to the surface for pickup of another log.

It is an objective of the present invention to provide a method for submerging floatation bodies which does not require expensive equipment.

It is a further objective of the present invention to provide such a method which allows placement of the bodies quickly and easily.

It is a further objective of the present invention to provide such a method which doesn't require the use of highly trained operators.

It is a still further objective of the present invention to provide an apparatus which facilitates the operation of the aforesaid method.

The foregoing and other objects, features, and advantages of the principal invention will be more readily understood upon consideration of the following detailed description taken in conjunction with the accompanying drawings.

DETAILED DESCRIPTION OF THE INVENTION

Figure 1:
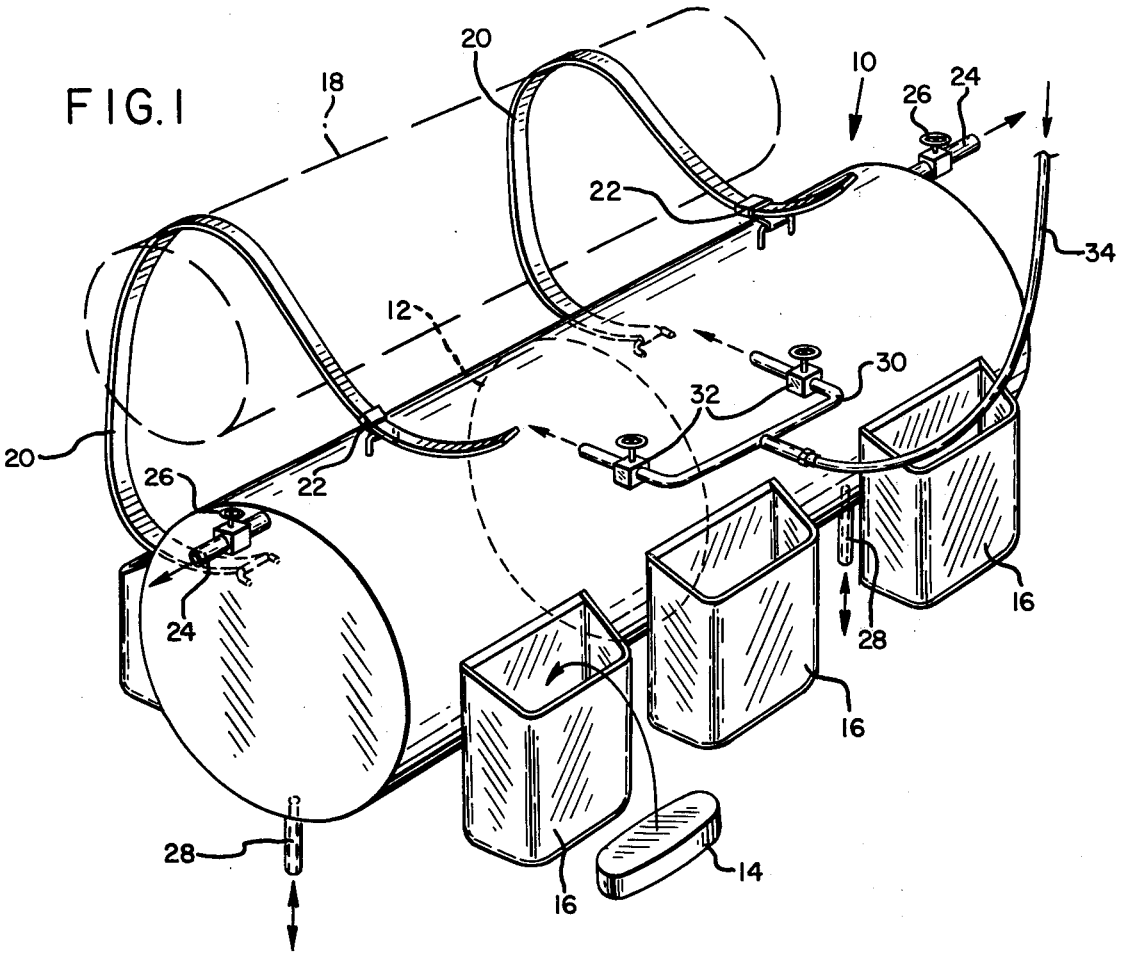
FIG. 1 is a pictorial view showing a preferred embodiment of the apparatus of the present invention.
Figure 2:
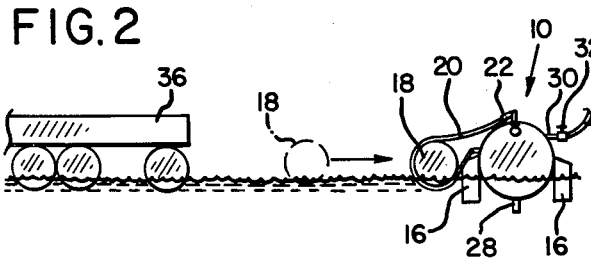
FIGS. 2–5 are diagrammatic views showing the sequence used in the method of the present invention.

Referring to FIG. 1 of the drawings, the apparatus of the present invention comprises a tank 10, which is shown as being cylindrical and which is divided into two equal volume compartments by a central divider 12. The compartments are sealed so that the tank will float when placed in water, however preferably the tank is constructed from a heavy material, such as steel, so that it floats low in the water. In addition weights 14 are attached to the tank along both of its sides to further lower the level at which the tank floats. The weights are located below the horizontal centerline of the tank and are distributed evenly on both of its sides to provide rotational stability to the tank, both when it is floating and when it is submerged. In the embodiment illustrated the weights are releasably located in pockets 16 which are attached to the tank to provide flexibility in setting the net weight of the tank.

When weights 14 are in place, the gross weight of the tank is greater than the buoyancy force of a floatation element, such as a styrofoam log, which is to be submerged by the apparatus. Thus by varying the amount of weights 14 which are added, the tank can be used for submerging logs having a wide range of buoyancy forces. However, as noted above, the size of the tank is sufficient that when it is filled with air it has adequate buoyancy to float itself and weights 14.

Straps 20 are provided for releasably securing log 18 to tank 10. The straps are fixedly attached to the tank at one of the their ends and are adjustably fastened at their other ends by buckles 22. Thus the length of the loops formed by the straps is adjustable to accommodate logs of various sizes.

Located at the tops of each compartment is air outlet means, such as tube 24, having a manually operated valve 26 located therein. Fluid passageway means, such as pipe 28, opens into each compartment at the bottom of the tank. Accordingly, by opening valves 26 the respective compartments can be selectively flooded through pipes 28, thereby submerging the tank to whatever level is desired.

Air inlet means, such as manifold 30, enters each compartment proximate the top of the tank for refilling the tank with air when it is to be resurfaced. Control valves 32 are located in the manifold adjacent to each compartment to allow selectively controlling the air entering the respective compartments. An air line 34 interconnects the manifold and a compressor (not shown), or other means of generating pressurized air, which is located on the surface.

The method by which the above-described apparatus is used to submerge a floatation body is shown sequentially in FIGS. 2–5. Prior to use sufficient weights 14 are added to pockets 16 to make the gross weight of tank 10 greater than the buoyancy of the styrofoam log 18 which is to be submerged. Since the weight pockets are located below the horizontal centerline of the tank, when weights are added the tank is rotationally stable both when surfaced and when submerged. With the apparatus and the log floating near the structure 36 which is to be supported, the log is secured to the tank by wrapping straps 20 tightly around the log and fastening them to buckles 22, FIG. 2.

Figure 3:
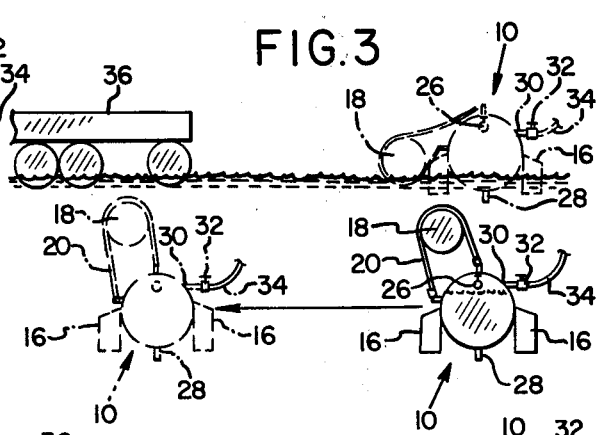

The tank, and thus the log, then is submerged, FIG. 3, by opening valves 26, thus allowing air to be displaced from the respective compartments through tubes 24 by water which enters the tank through pipes 28. It will be noted that by dividing the tank into compartments, with each having individual fluid passageways and air inlet means, the attitude of the tank can be controlled during flooding by selective manipulation of valves 26. Otherwise air pockets could form at one end of the tank causing it to become unstable and roll end over end as air is evacuated. Once the log is submerged to a level below the bottom of structure 36, the apparatus and log are manipulated, by means such as a diver, to a position wherein the log is properly located beneath the structure.

Figure 4:
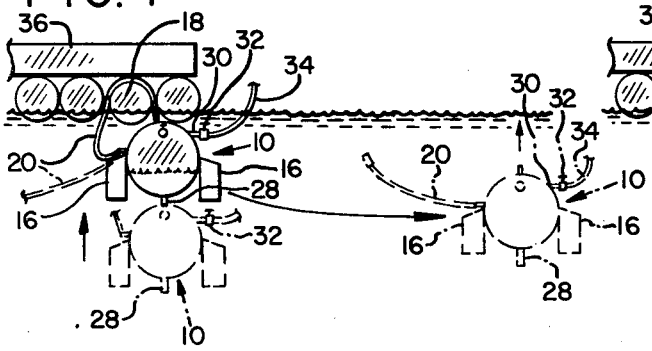

The log is then raised until its buoyancy force is completely transferred to the floating structure, FIG. 4, by refilling the tank with air. Pressurized air from a remote source, such as a compressor and storage tank (not shown), is supplied through line 34 and manifold 30 into the respective compartments by opening the associated valves 32. Thus water is forced out of pipes 28 thereby increasing the buoyancy of the tank. However, the tank is not completely refilled with air but only sufficient air is introduced to raise the tank to a level wherein the log is supported by the structure. Then straps 20 are removed from the log and the apparatus is maneuvered out from under the structure.

It will be noted that by introducing air selectively into both compartments, the tank can be maintained horizontal while it is raised, in the same manner as when it was lowered.

Figure 5:
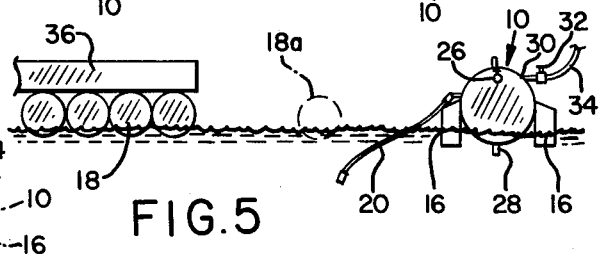

The apparatus then is raised to the surface, FIG. 5, by fully refilling the compartments with air in the same manner as just described. At this point the apparatus is ready to be attached to another log **18*a*** and the process repeated.

The terms and expressions which have been employed in the foregoing abstract and specification are used therein as terms of description and not of limitation, and there is no intention in the use of such terms and expressions of excluding equivalents of the features shown and described or portions thereof, it being recognized that the scope of the invention is defined and limited only by the claims which follow.

What is claimed is:

1. The method of positioning a high buoyancy floatation body beneath a structure floating on a liquid, said method comprising:

(a) releasably attaching the floatation body to a tank having a negative buoyancy force, when filled with a fluid having a density approximately equal to that of said liquid on which said structure is floating, which is greater than the buoyancy force of the floatation body, and a volume which is sufficient to cause said tank to float when it is filled with a gaseous substance having a predetermined density;

(b) filling said tank sufficiently with a fluid, having a density approximately equal to the density of the liquid on which said tank and floatation body are floating, so as to cause said tank and floatation body to become submerged to a level below the bottom of said floating structure;

(c) manipulating said tank and floatation body, when submerged, to a position wherein said floatation body is located beneath said floating structure;

(d) displacing a portion of said fluid by introducing a volume of said gaseous substance into said tank so as to raise said floatation body to a position wherein its buoyancy force is completely transferred to said floating structure; and (e) disconnecting said floatation body from said tank, and moving said tank from beneath said floating structure.

2. The method of claim 1 wherein said gaseous substance is air.

3. The method of claim 1 wherein said fluid is water.

4. The method of claim 1 including the step of selectively locating a portion of the gross weight of said tank in a manner such that said tank remains rotationally stable when submerged and when floating.

5. Apparatus for positioning a high buoyancy floatation body beneath a structure floating in a body of water comprising:

(a) an elongate tank, having a top, a bottom and sides;

(b) means of releasably securing said floatation body to said tank;

(c) said tank having, when filled with water, a negative buoyancy force which is greater than the buoyancy force of said floatation body, and having a volume which is sufficient to cause said tank to float when it is filled with air;

(d) said tank being divided along its longitudinal axis into at least two isolated compartments;

(e) fluid passageway means located proximate the bottom of said tank, one entering each said compartment, for allowing water to enter and to be evacuated from said compartment;

(f) air outlet means located proximate the top of said tank, one entering each said compartment, each said air outlet means including a valve configured for selectively releasing air from its associated compartment so as to allow inflow of water into said compartment through its respective fluid passageway; and (g) air inlet means located in the tank, one entering each said compartment, each said air inlet means including a control valve arranged for selectively admitting pressurized air into its associated compartment so as to force water out of said compartment through its respective fluid passageway means.

6. The apparatus of claim 5 including;

(a) means for generating air at a predetermined pressure sufficient to displace the water from said tank when the tank is submerged, and (b) an air line interconnecting said means for generating air and said air inlet means.

7. The apparatus of claim 5 wherein more than one-half of said gross weight is located below the horizontal centerline of said tank, and said gross weight is evenly distributed between both sides of said tank, so as to rotationally stabilize said tank, both when submerged and when floating.

8. The apparatus of claim 7 including weight pockets attached to each side of said tank, said weight pockets being configured for removably receiving a portion of said gross weight.

9. The apparatus of claim 5 wherein said means for securing said floatation body to said tank comprises straps, and buckles configured for securing said straps in closed loops having adjustable lengths.

* * * * *